US008696398B2

(12) United States Patent
Steger

(10) Patent No.: US 8,696,398 B2
(45) Date of Patent: Apr. 15, 2014

(54) QUICK DETACH INFLATABLE LIFEJACKET

(76) Inventor: Ralph E. Steger, Baxley, GA (US)

( * ) Notice: Subject to any disclaimer, the term of this patent is extended or adjusted under 35 U.S.C. 154(b) by 688 days.

(21) Appl. No.: 12/673,541

(22) PCT Filed: Aug. 15, 2008

(86) PCT No.: PCT/US2008/073398
§ 371 (c)(1),
(2), (4) Date: Jan. 11, 2011

(87) PCT Pub. No.: WO2009/026185
PCT Pub. Date: Feb. 26, 2009

(65) Prior Publication Data

US 2011/0097953 A1 Apr. 28, 2011

Related U.S. Application Data

(60) Provisional application No. 60/965,134, filed on Aug. 16, 2007.

(51) Int. Cl.
*B63C 9/125* (2006.01)

(52) U.S. Cl.
USPC ..... 441/106

(58) Field of Classification Search
USPC ..... D21/804, 805; 441/106–121, 88
See application file for complete search history.

(56) References Cited

U.S. PATENT DOCUMENTS 1,111,010 A * 9/1914 Depta ..... 441/119
5,393,254 A * 2/1995 Ducheshe ..... 441/118

FOREIGN PATENT DOCUMENTS

GB 1249496 10/1971
GB 2256832 A 12/1992

* cited by examiner

*Primary Examiner* — Edwin Swinehart

(57) ABSTRACT

A personal flotation is provided having a body harness portion and an inflatable lifejacket portion. The body harness portion is positionable on a wearer. The lifejacket is positionable about the neck of the wearer, where the lifejacket portion is removably secured to the body harness portion with a quick release connector. The lifejacket can be removed from the wearer by decoupling lifejacket portion from the body harness portion, and removing the lifejacket portion from about the neck of the wearer. The body harness portion will remain positioned on the wearer.

11 Claims, 12 Drawing Sheets

QUICK DETACH INFLATABLE LIFEJACKET

FIELD OF THE INVENTION

The present disclosure relates to personal flotation devices, and more particularly to an easily removable low profile personal flotation device.

BACKGROUND OF THE INVENTION

An inflatable lifejacket can be fitted to the body of a wearer by means of a harness and buckles, and the like. Alternatively, a lifejacket can be integrated into an article of clothing or specialized outerwear, such as a water survival suit.

Because of their function, lifejackets have been developed to inflate in a number of different ways. An automatic inflatable lifejacket includes a pressure and/or water sensitive device which automatically releases inflating medium into an inflatable bladder upon activation, for example when a wearer falls into the water. Alternatively, the lifejacket can include a manual actuation mechanism for inflating the lifejacket, where the mechanism is activated by the wearer to release the inflating medium. The inflating medium typically is a cartridge of gas which is held under pressure. Such inflation medium may for example be carbon dioxide.

To provide an increased range of motion while being worn, lifejackets can be provided in a collapsed or deflated state, where the inflatable bladder is held within a flexible casing. Upon inflation, the flexible casing gives way, allowing the inflatable bladder to open in a controlled fashion.

A type of lifejacket is a split front twin lobe, or horse-shoe type, lifejacket, which is fitting about the wearer's neck and includes twin parallel legs extending along the torso of the wearer. This lifejacket includes an inflatable bladder fitted within a flexible casing. A harness is affixed to the lifejacket for securing the lifejacket to the body of the wearer, or the casing can be fixed to an outerwear. Because of the shape of the casing, the wearer has an increased range of motion, with minimal interference from the lifejacket. When the split front lifejacket is inflated, the front legs, along the torso of wearer, and the collar portion, about the neck of the wearer, inflate to provide buoyancy to the wearer. The collar portion provides the additional advantage of providing buoyancy to the wearer's neck and head.

SUMMARY OF THE INVENTION

The present disclosure provides a personal flotation device including a body harness portion and an inflatable lifejacket portion removably attachable to the body harness portion. The body harness portion includes a waist belt positionable about the waist of a wearer. A body strap is provided having a first end affixed to the waist belt and a second looped end positionable proximal to the chin of the wearer.

The lifejacket portion including an inflatable bladder being inflatable from a deflated condition to an inflated condition. An outer casing is positionable about the inflatable bladder in a deflated condition. The outer casing has a generally u-shape defining a collar portion and first and second longitudinally extending legs. A neck strap is provided having first strap section affixed to the first longitudinally extending leg and a second strap section affixed to the second longitudinally extending leg. A quick release connector is provided to releasably connect the first and second strap sections.

The lifejacket portion is releasably connected to the body harness by removably threading the first strap section through the second looped end of the body strap on the body harness portion. The first strap section is detachably connected to the second strap section with the quick release.

The lifejacket portion is separated from the body harness portion by decoupling the first strap section of the neck strap from the quick release. The first strap section is unthreaded through the second looped end of the body strap on the body harness portion.

In method of use, the body harness portion is positioned on the wearer. The waist belt is removably positioned about a waist of the wearer, where the second looped end of the body strap is positioned on the chest of the wearer, below the chin.

The lifejacket is positioned about the neck of the wearer. The lifejacket is secured on the wearer, the first strap section of the neck strap is threaded through the second looped end of the body strap and removably coupled to a quick release connector on a second strap section of the neck strap, and The lifejacket can be removed from the wearer by decoupling the first strap section of the neck strap from the quick release connector of the second strap section of the neck strap. The first strap section is unthreaded from the second looped end of the body strap. The lifejacket portion is removed from about the neck of the wearer, wherein the body harness portion remains positioned on the wearer.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
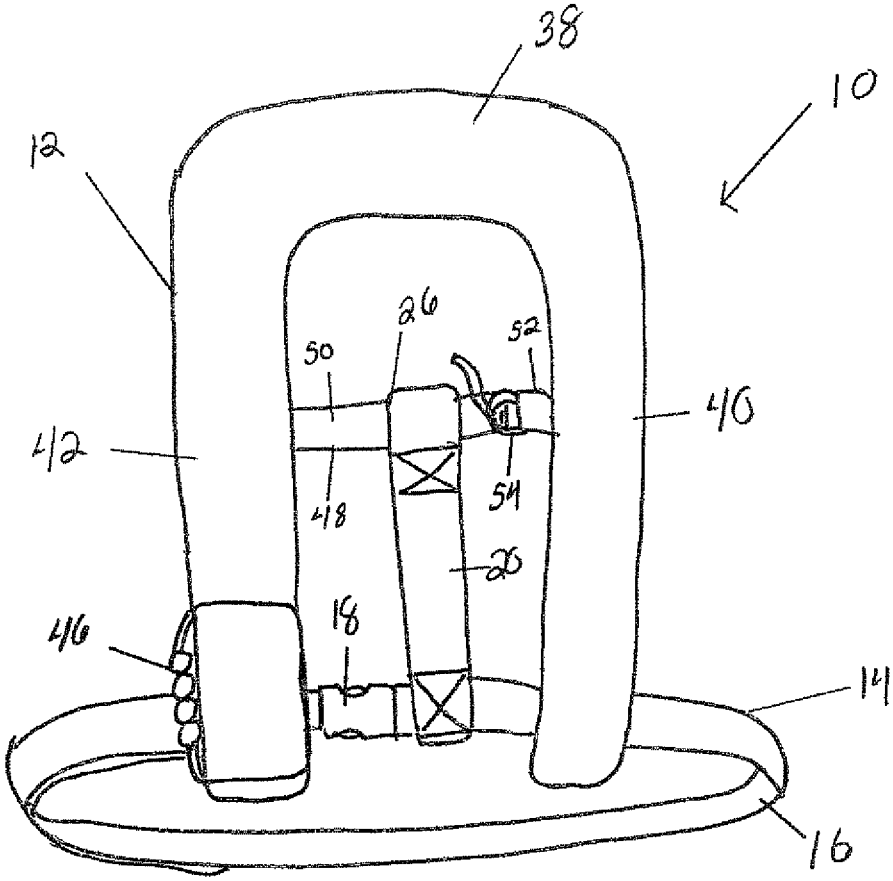
FIG. 1 depicts a personal flotation device of the present disclosure.

Referring now to the drawing figures in which like reference designators refer to like elements, there is shown in FIG.

1 a personal flotation device 10 of the present disclosure. The personal flotation device 10 includes a lifejacket portion 12 and a body harness portion 14, where the body harness portion 14 secures the lifejacket portion 12 to the body of a wearer.

Figure 2:
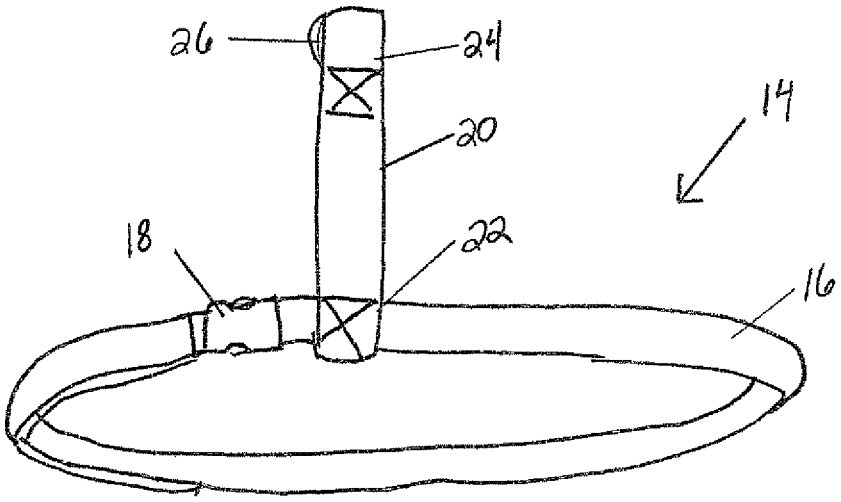
FIG. 2 depicts a body harness portion of the personal flotation device of FIG. 1.

Referring to FIG. 2, the body harness portion 14 includes an adjustable waist belt 16 which is positionable about the waist of the wearer. The waist belt 16 includes a connector 18, such as a buckle or clip, for securing the waist belt 16 about the waist of the wearer. A body strap 20 is provided, where a first end 22 of the body strap 20 is affixed to the waist belt 16 and a second end 24 of the body strap 20 include a loop 26.

Figure 3:
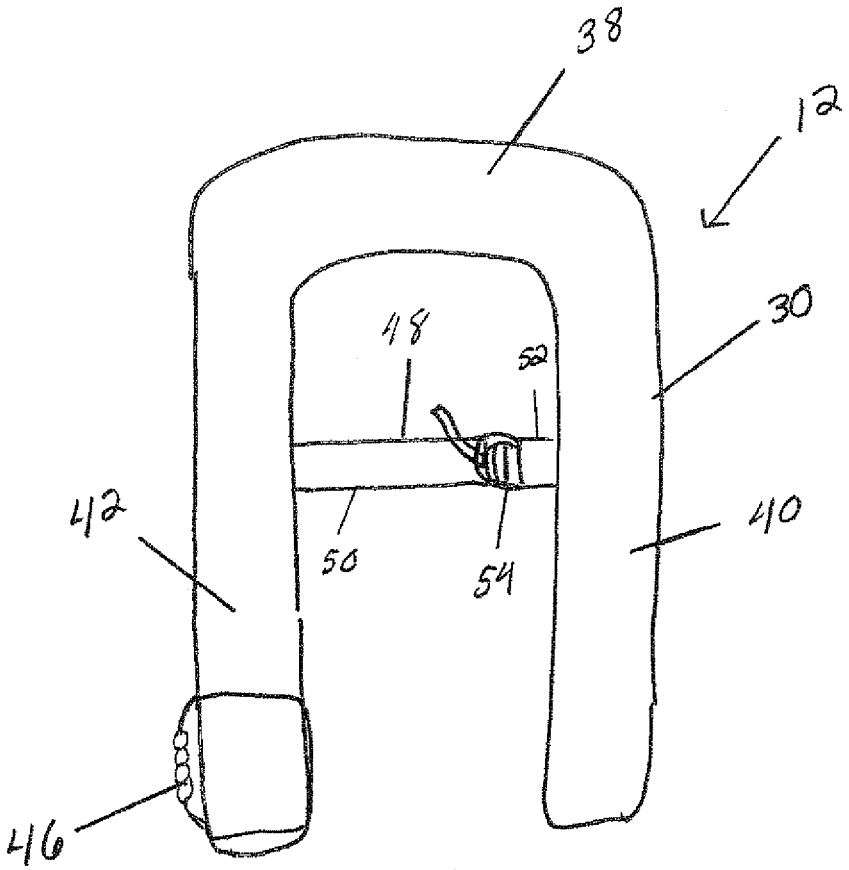
FIG. 3 depicts a lifejacket portion of the personal flotation device of the FIG. 1.
Figure 4:
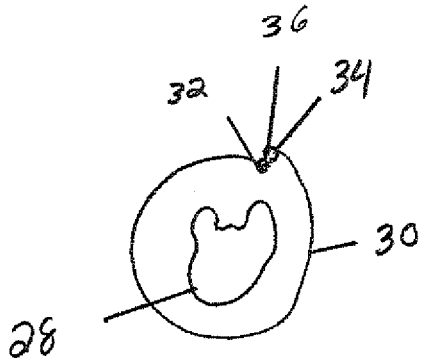
FIG. 4 depicts a cross-sectional view of the lifejacket portion of FIG. 3.

Referring to FIGS. 3 and 4, the lifejacket portion 12 includes an inflatable bladder 28 contained within an outer casing 30. The outer casing 30 is of flexible fabric wrapped into tubular form, the free edges 32, 34 of which are joined together by a fastening mechanism 36, such as zippers, hook and loop fasteners, and the like. Exemplary fastening mechanisms 36 are also provided in U.S. Pat. Nos. 4,297,758; 6,589,088; and 6,832,415 the contents of which are herein incorporated by references in their entirety.

The inflatable bladder 28 of the lifejacket portion 12 is folded within the outer casing 30 in a deflated condition. The lifejacket portion 12 is provided in a horse-shoe (u-shape) shape having a collar portion 38 and a pair of longitudinally extending legs 40, 42.

An inflation mechanism 44 is provided on at least one of the longitudinally extending legs 40, 42. The inflation mechanism 44 includes a container, such as a cylinder, containing an inflation medium. A release mechanism 46 is provided which can be actuated to release the inflation medium from the container. The release mechanism can be either a manual or automatic release mechanism. An exemplary inflation mechanism is provided in U.S. Pat. No. 6,589,088 the contents of which is herein incorporated by reference in its entirety.

For a manual release mechanism, an inflation tab 47 is provided, the pulling of which releases the inflation medium from the container to inflate the inflatable bladder 28. The inflation of the inflatable bladder 28 overcomes the fastening mechanism 36, separating the edges 32, 34 of the outer casing 30 and opening outer casing 30 to enable the inflatable bladder 28 to expand.

In addition the inflation mechanism 44, a manual inflation mechanism can be included. As is known, the manual inflation mechanism can include an inflation tube in fluid communication with the inflatable bladder 20. A one-way valve is provided inline with the inflation tube, preventing the release of air from the inflatable bladder 28. To inflate the inflatable bladder 28, the wearer exhales through the inflation tube into the inflatable bladder 28. The manual inflation mechanism can be used to completely inflate the inflatable bladder 28, or to maintain a previously inflated inflatable bladder 28 in a fully inflated condition.

A neck strap 48 is connected to and traverses between the longitudinally extending legs 40, 42. The neck strap 48 includes first and second strap sections 50, 52 coupled together by a quick release connector 54. An activation of the quick release 54 decouples the first strap section 50 from the second strap section 52.

As shown in FIG. 1, the lifejacket portion 12 is connected to the body harness portion 14 by threading the neck strap 48 of the lifejacket portion 12 through the looped end 26 of the body strap 20 of the body harness 12. This can be accomplished by first using the quick release connector 54 to decouple the first and second strap sections 50, 52 of the neck strap 48. The first strap section 50 of the neck strap 48 is threaded through the looped end 26 of the body strap 20. The first and second strap sections 50, 52 of the neck strap 48 are recoupled using the quick release connector 54.

Figure 5:
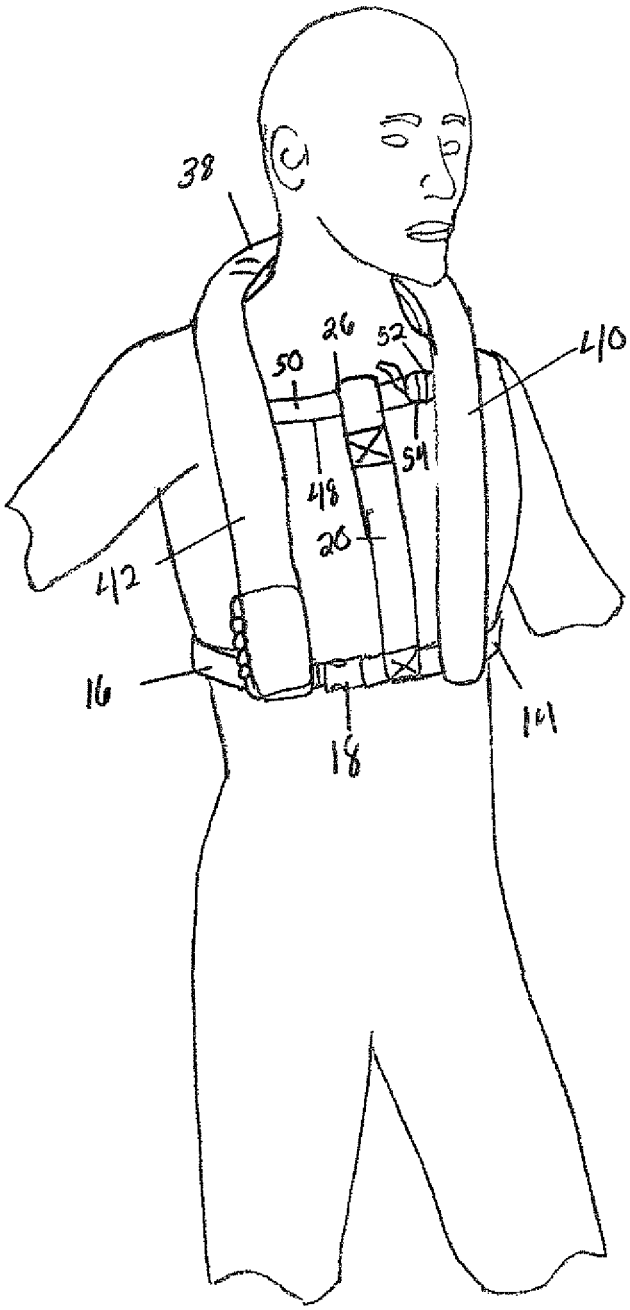
FIG. 5 depicts the personal flotation device of FIG. 1 adorned by a wearer.
Figure 6:
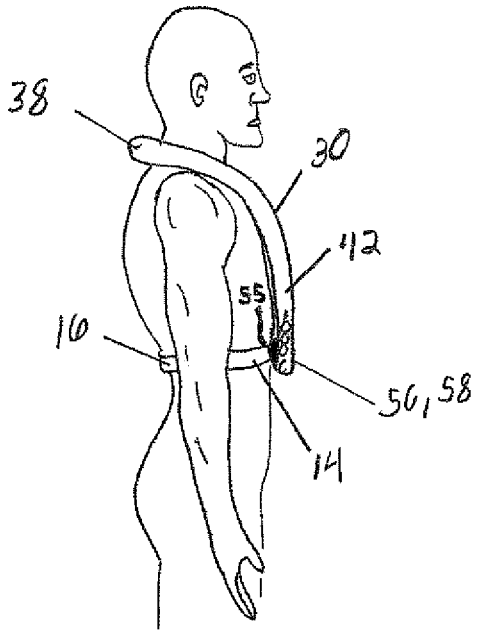
FIG. 6 depicts a side view of the personal flotation device of FIG. 1 adorned by a wearer.

Referring to FIGS. 5 and 6, the personal flotation device 10 is adorned by the wearer, where the lifejacket portion 12 is positioned over the head of the wearer, with the collar portion 38 wrapping around the back of the wearer's neck and the longitudinally extending legs 40, 42 extending downwardly along the torso of the wearer.

The waist belt 16 is positioned and secured about the wearer's waist. The waist belt 16 is adjusted to snuggly fit about the waist of the wearer.

The body strap 20 is positioned along the torso of the wearer, such that the looped end 26 of the body strap 20 is positioned beneath the chin of the wearer. As the neck strap 48 is threaded through the looped end 26 of the body strap 20, the neck strap 48 is positioned across the chest of the wearer, below the wearer's chin. The length of the neck strap 48 can be adjustable, to snuggly fit the lifejacket portion 12 to the wearer.

The bottom ends 56, 58 of the longitudinally extending legs 40, 42 of the lifejacket portion 12 can be removable secured to the body harness 12. For example, hook and loop fasteners can be provided on the waist belt 16 and the bottom ends 56, 58 of the longitudinally extending loops 40, 42.

Figure 7:
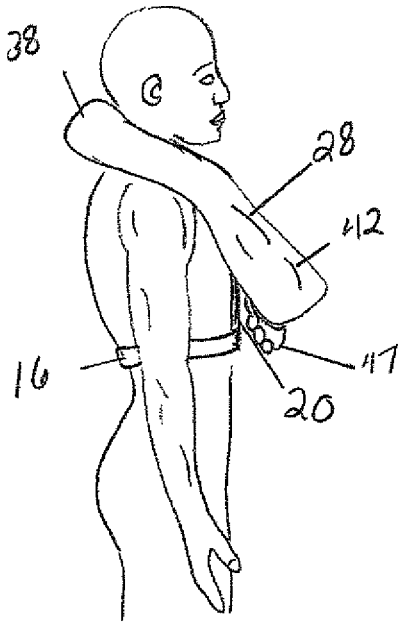
FIG. 7 depicts a side view of the personal flotation device of FIG. 1 adorned by a wearer in an inflated condition.

Referring to FIG. 7, to inflate the lifejacket portion 12 the wearer pulls on the inflation tab 47 connected to the inflation mechanism 44 releasing the inflation medium from the container. The inflation of the inflatable bladder 28 overcomes the fastening mechanism 36, separating the edges 32, 34 of the outer casing 30 and opening outer casing 30 to enable the inflatable bladder 28 to expand.

The collar portion 38 and the longitudinally extending legs 40, 42 expand, providing buoyancy to the wearer. The positioning of the collar portion 38 about the back of the neck of the wearer and the neck strap 48 under the wearer's chin prevent the inflated bladder 28 from being raised over the wearer's head.

To remove the lifejacket portion 12 from the wearer, the waist belt 18 connector is opened, allowing the waist belt 16 to be removed from about the wearer's waist. The quick release connector 54 is used to loosen the neck strap 48, allowing longitudinally extending legs 40, 42 to be separated a sufficient distance to lift the lifejacket portion 12 over the head of the wearer. This method can be used to remove to the lifejacket portion 12 from the wearer in either the inflated or deflated condition.

To quickly remove the lifejacket portion 12 from the wearer, the quick release connector 54 is used to decouple the first and second strap sections 50, 52 of the neck strap 48. The first strap section 50 of the neck strap 48 is unthreaded through the looped end 26 of the body strap 20 body harness portion 14, separating the lifejacket portion 12 from the body harness portion 14. As the longitudinally extending legs 40, 42 are no longer connected together with the neck strap 48, the longitudinally extending legs 40, 42 can be separated to remove the lifejacket portion 12 from about the wearer's neck. In this method, the body harness portion 14 remains on the wearer. This method can be used to quickly remove to the lifejacket portion 12 from the wearer in either the inflated or deflated condition.

Figure 8:
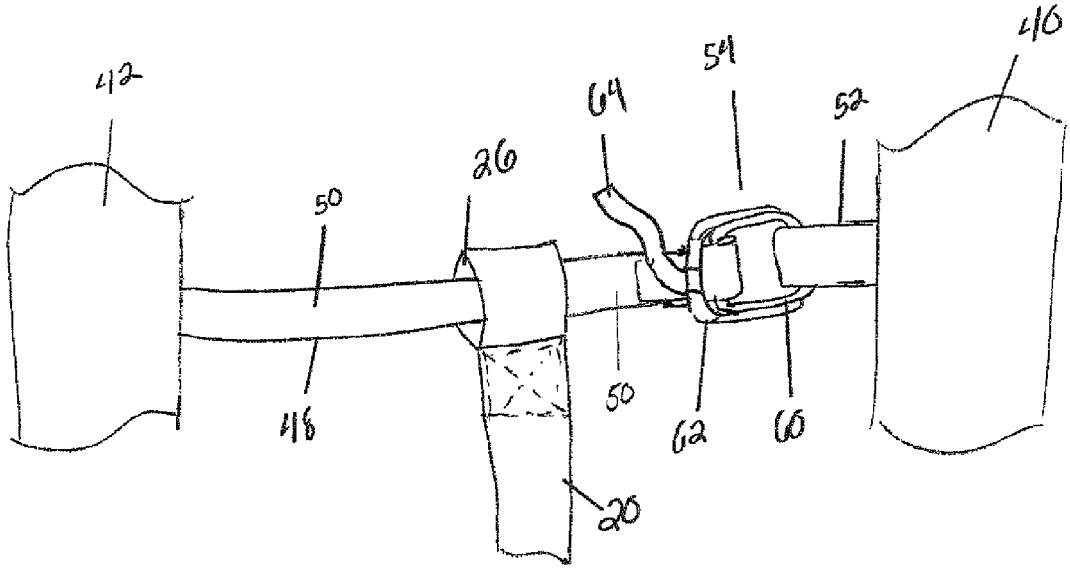
FIG. 8 depicts an exemplary quick release connector for use with the lifejacket portion of FIG. 3.

Referring to FIG. 8, an exemplary quick release connector 54 is provided. The quick release connector 54 includes first and second ring members 60, 62 attached to the second strap section 52 of the neck strap 48. The first strap section 50 of the neck strap 40 is threaded through the first and second rings 60, 62, securing the first and second strap sections 50, 52 of the neck strap 48 together therein. The length of the neck strap 48 can be adjusted by further pulling the first strap section 50 of the neck strap 40 through the first and second rings 60, 62. A release tap 64 is connected to the second ring 62, a pulling of which in the direction of the second strap section 52 of the neck strap 48 raises the first and second rings 60, 62, loosening first strap section 50 from the first and second rings 60, 62, allowing for the removal thereof. U.S. Pat. No. 4,175,304 entitled Strap Closure provides an example of the above quick release connector, the contents of which is herein incorporated by reference in its entirety.

Additional quick release strap connectors are also provided in U.S. Pat. Nos. 3,277,543, 4,670,945, and 5,438,734, the contents of which are herein incorporated by reference in their entirety. Furthermore, the above recited quick release connectors are only exemplary in nature, and it is envisioned that any quick release strap connector can be utilized.

The personal flotation device 10 can additionally be utilized with mission specific type outerwear, allowing for the quick removal of the lifejacket portion 12 without having to remove the outerwear. Alternatively, the outerwear can be removed without the removal of the lifejacket portion 12.

Figure 9:
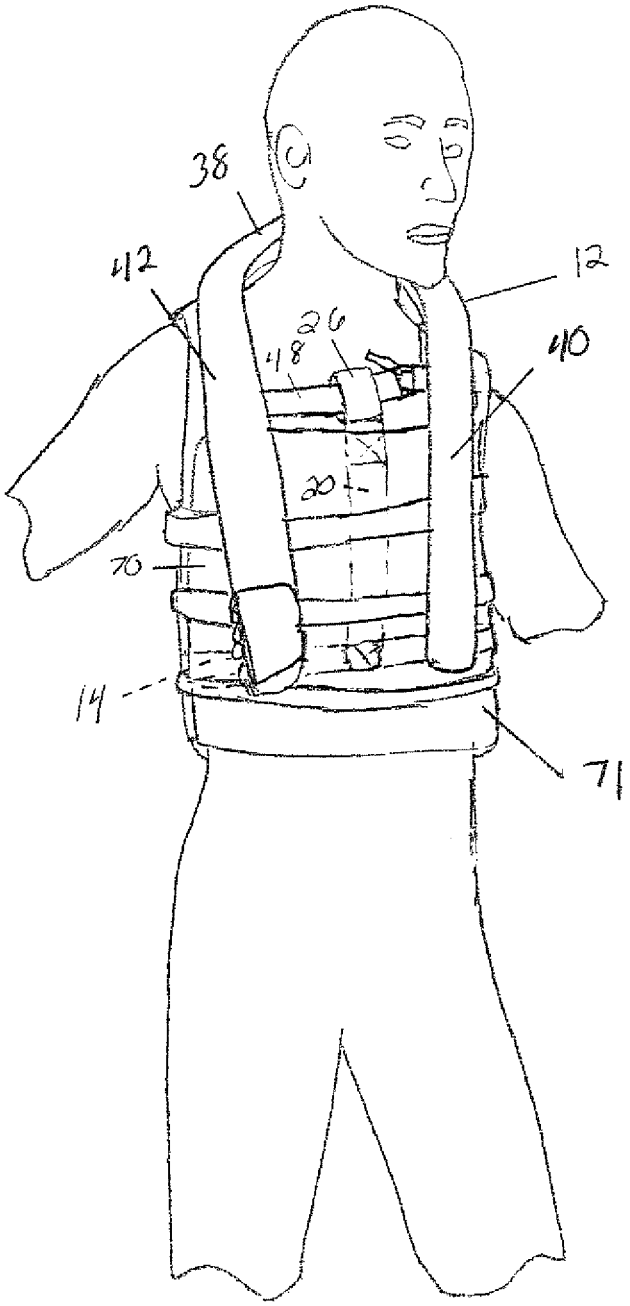
FIG. 9 depicts a personal flotation device of FIG. 1 used in conjunction with an article of outerwear.
Figure 10:
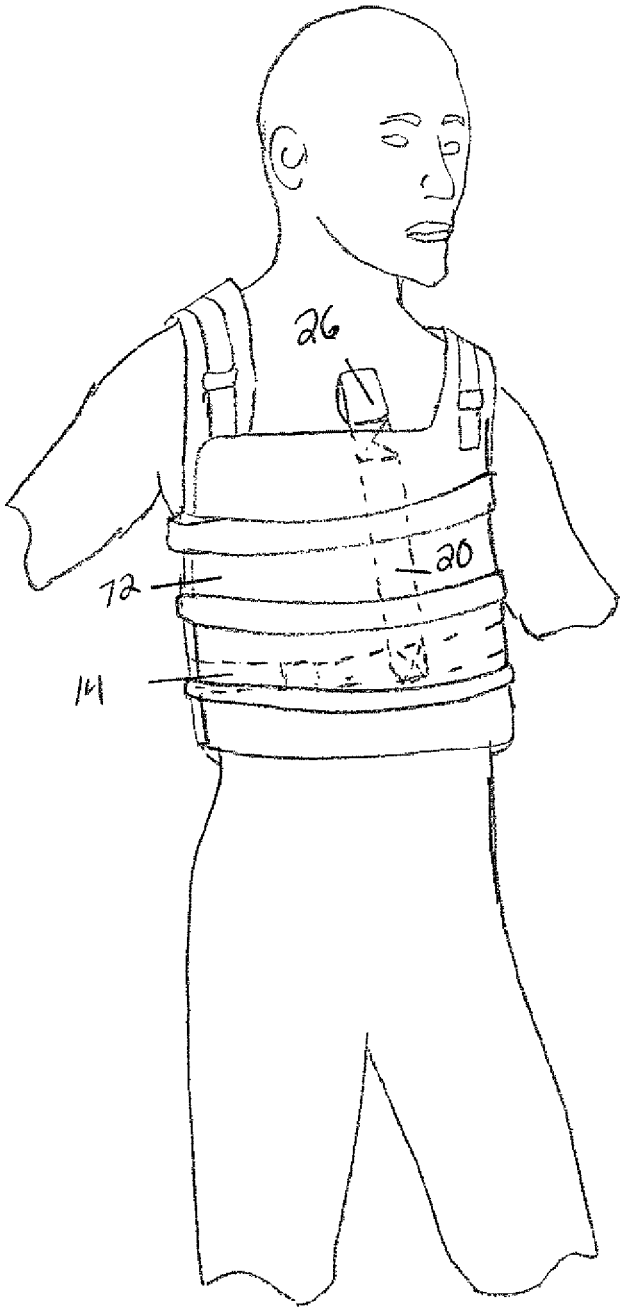
FIG. 10 depicts the harness portion of FIG. 2 in conjunction with the article of outerwear.

Referring to FIGS. 9 and 10, an exemplary mission specific outerwear is provided in the form of ballistic armor 70. In use, a wearer initially dons the body harness portion 14 of the personal flotation device 10, where the waist belt 16 is positioned and secured about the wearer's waist. The waist belt 16 is adjusted to snuggly fit about the waist of the wearer. The body strap 20 is positioned along the torso of the wearer, such that the looped end 26 of the body strap 20 is positioned beneath the chin of the wearer.

The ballistic armor 70 is adorned over the body harness portion 14. The looped end 26 of the body strap 20 extends out from the ballistic armor 70, beneath the chin of the wearer.

The lifejacket portion 12 is positioned over the head of the wearer, with the collar portion 38 wrapping around the back of the wearer's neck and the longitudinally extending legs 40, 42 extending downwardly along the outer surface 71 of the ballistic armor 70, along the torso of the wearer. The neck strap 48 is threaded through the looped end 26 of the body strap 20, the first and second strap section 50, 52 being connected with the quick release connector 54. The length of the neck strap 48 can be adjustable, to snuggly fit the lifejacket portion 12 to the wearer.

Alternatively, the personal flotation device 10 can first be adorned by the wearer. The ballistic armor 70 can then be positioned under the lifejacket portion, where the ballistic armor 70 covers the body harness portion 14. The length of the neck strap 48 can be adjustable, to snuggly fit the lifejacket portion 12 over the ballistic armor 70 on the wearer.

To quickly remove the lifejacket portion 12 from the wearer, the quick release connector 54 is used to decouple the first and second strap sections 50, 52 of the neck strap 48. The first section 50 of the neck strap 48 is unthreaded through the looped end 26 of the body strap 20, separating the lifejacket portion 12 from the body harness portion 14. As the longitudinally extending legs 40, 42 are no longer connected together with the neck strap 48, the longitudinally extending legs 40, 42 can be separated to remove the lifejacket portion 12 from about the wearer's neck. As the body harness portion 14 is worn under the ballistic armor 70 there is no need to remove the ballistic armor 70 for the removal of the life jacket 12. This method can be used to quickly remove to the lifejacket portion 12 from the wearer in either the inflated or deflated condition.

Alternatively, the ballistic armor 70 can be removed by the wearer without removing the lifejacket portion 12. Referring to FIG. 9, the ballistic armor 70 is secured about the wearer with a series of torso and shoulder straps. As the lifejacket portion 12 is only connected to the wearer by the looped end 26 of the body strap 20, the ballistic armor 70 can be removed from beneath the lifejacket portion 12 by uncoupling the torso and shoulder straps of the ballistic armor 70 and sliding the ballistic armor 70 from beneath the lifejacket portion 12.

Figure 11:
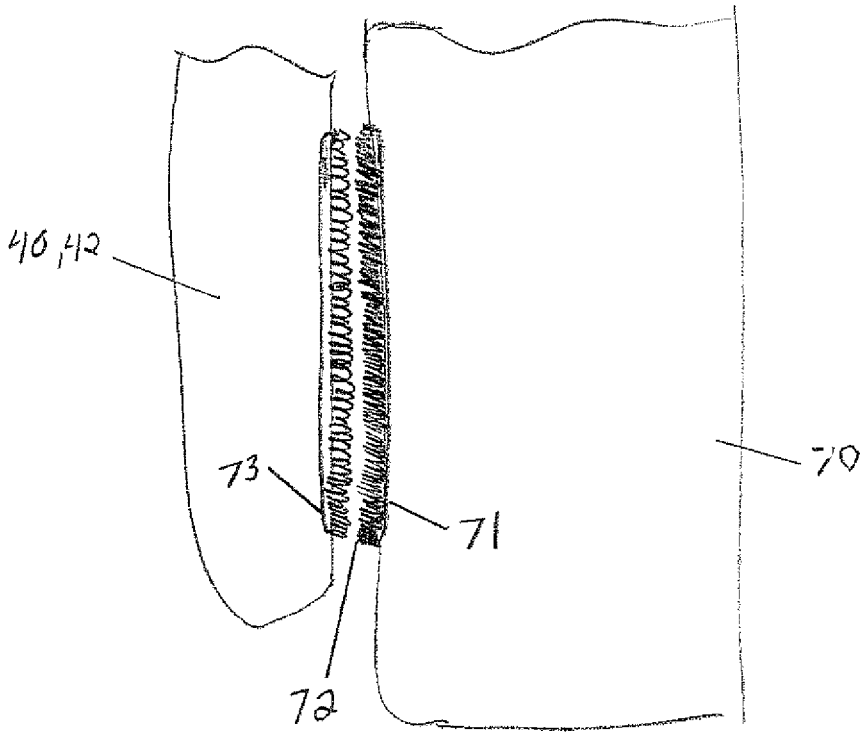
FIG. 11 depicts a sectional view of a system for removably connecting the lifejacket portion of FIG. 3 to the outerwear.

Referring to FIG. 11, the lifejacket portion 12 can be removable secured to the ballistic armor 70. For example, hook and loop fasteners 72 can be provided on the front surface 71 of the ballistic armor 70 and a back surface 73 of the longitudinally extending legs 40, 42. The lifejacket portion 12 can be separated from the ballistic armor 70 by separating the hook and loop fasteners 72.

Figure 12:
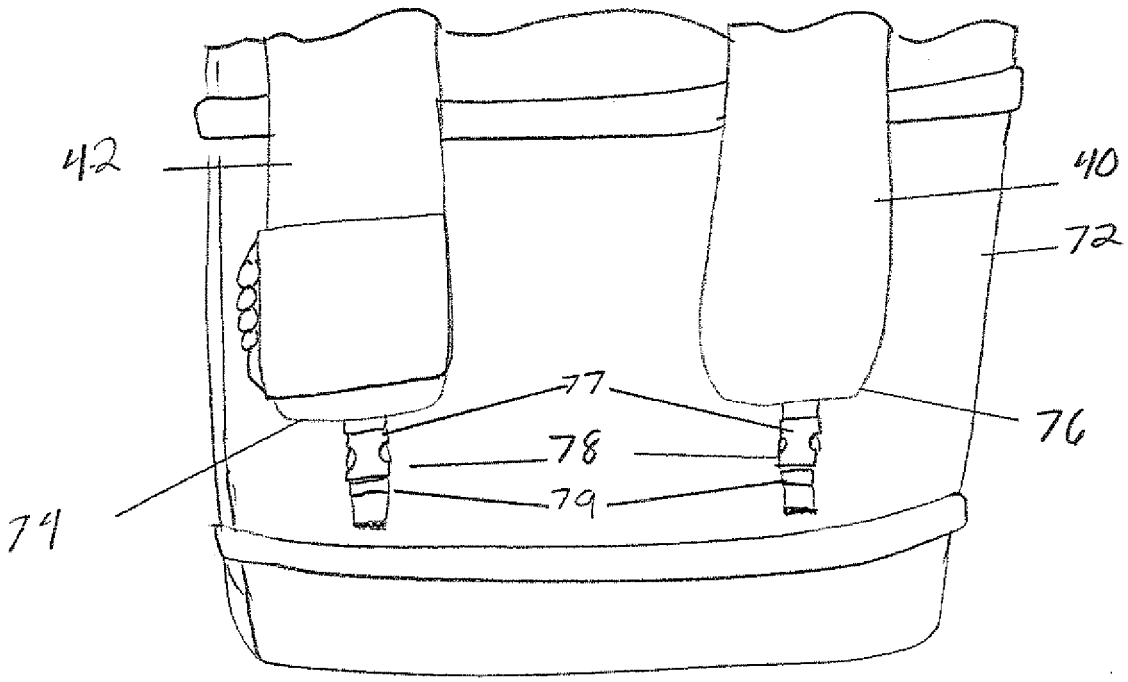
FIG. 12 depicts a sectional view of another system for removably connecting the lifejacket portion of FIG. 3 to the outerwear.

In another embodiment, the lifejacket portion 12 can be removably secured to the ballistic armor 70 using attachment clips. Referring to FIG. 12, the bottom ends 74, 76 of the longitudinally extending legs 40, 42 can each include a first portion 77 of attachment clip 78. A section portion 79 of the attachment clips 78 can be connected to the ballistic armor 70. The first and second portions 77, 78 of the attachment clips 78 can be removable coupled together, securing the lifejacket portion 12 to the ballistic armor 70. The lifejacket portion 12 can be separated from the ballistic armor 70 by decoupling the attachment clips 78 or by lifting them rotationally to disengage the webbing from the clips.

Figure 13:
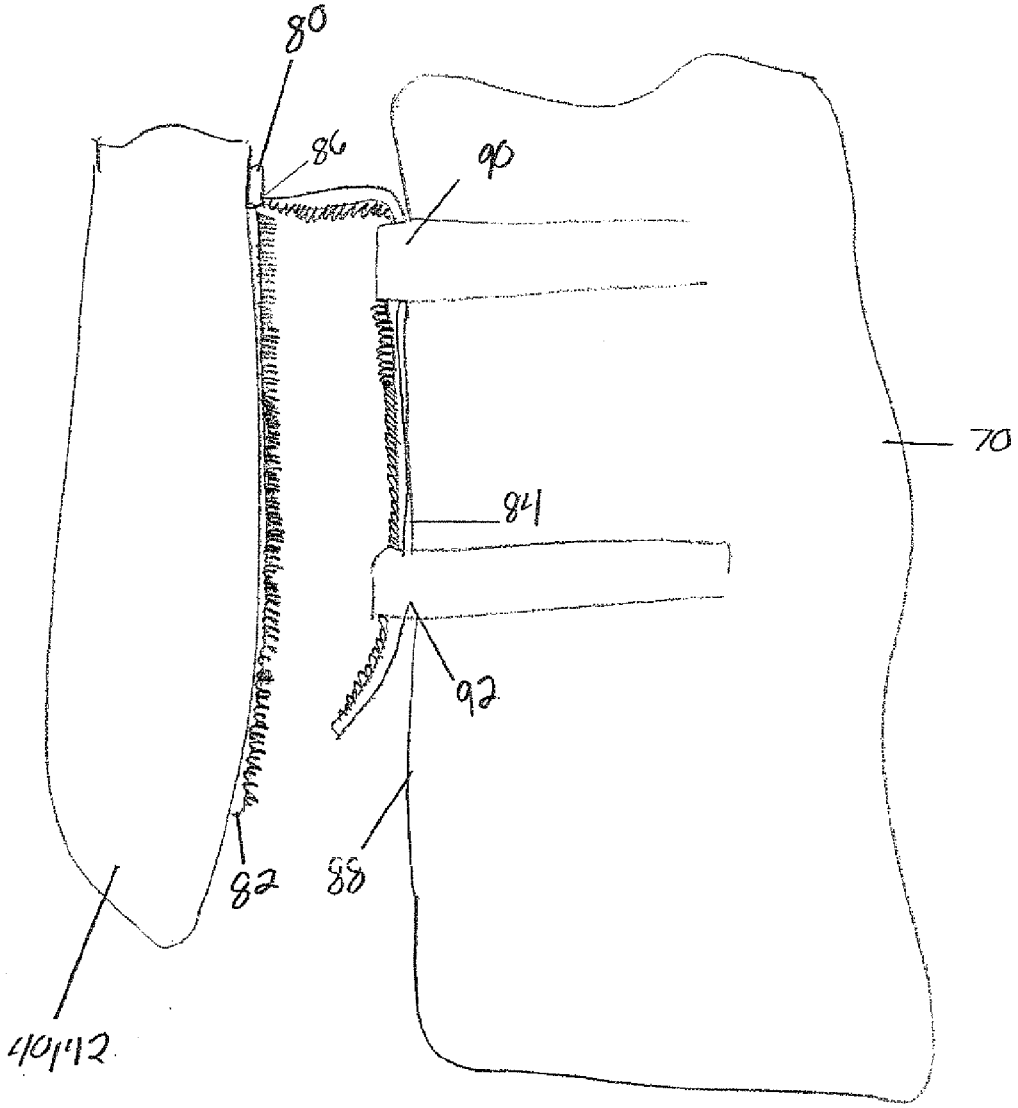
FIG. 13 depicts a sectional view of hook and loop strap system for removably connecting the lifejacket portion of FIG. 3 to the outerwear.
Figure 14:
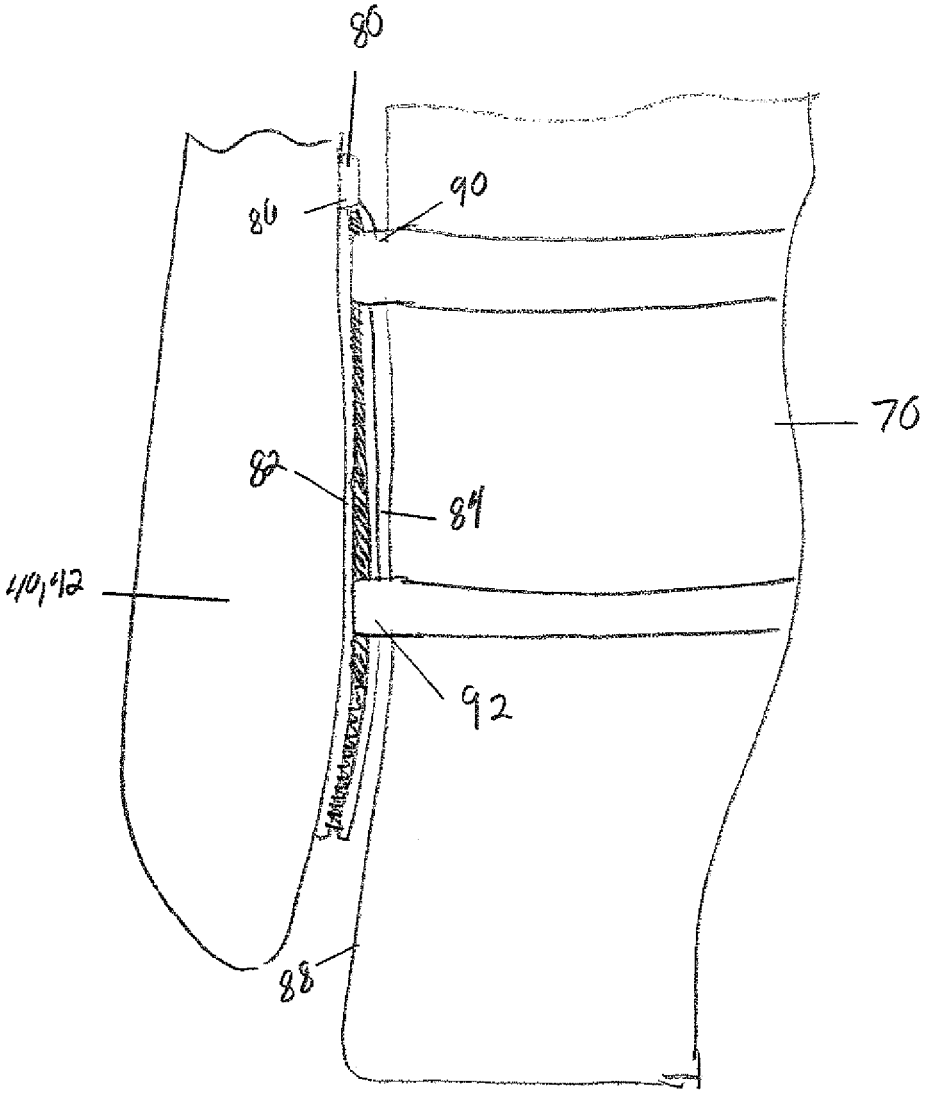
FIG. 14 depicts a sectional view of the hook and loop strap system of FIG. 13 in a connected configuration.

Referring to FIGS. 13 and 14, the back surface 73 of each of the longitudinally extending legs 40, 42 can include a hook and loop strap 80. Each of the hook and loop straps 80 includes a first section 82 affixed to the back surface 73 of the longitudinally extending legs 40, 42 and a second section 84, where the first and second sections 82, 84 are affixed together at their top end 86.

The second section 84 of the hook and loop strap 80 is threadable through straps 90, 92 on the front surface 71 of the ballistic armor 70. The second section 84 is pulled taught and compressed against the first section 82, securing the lifejacket portion 12 to the ballistic armor 70. The lifejacket portion 12 can be separated from the ballistic armor 70 by separating the second section 84 of the hook and loop strap 80 from the first section 82, and unthreading the second section 84 from the straps 90, 92 on the ballistic armor 70.

Figure 15:
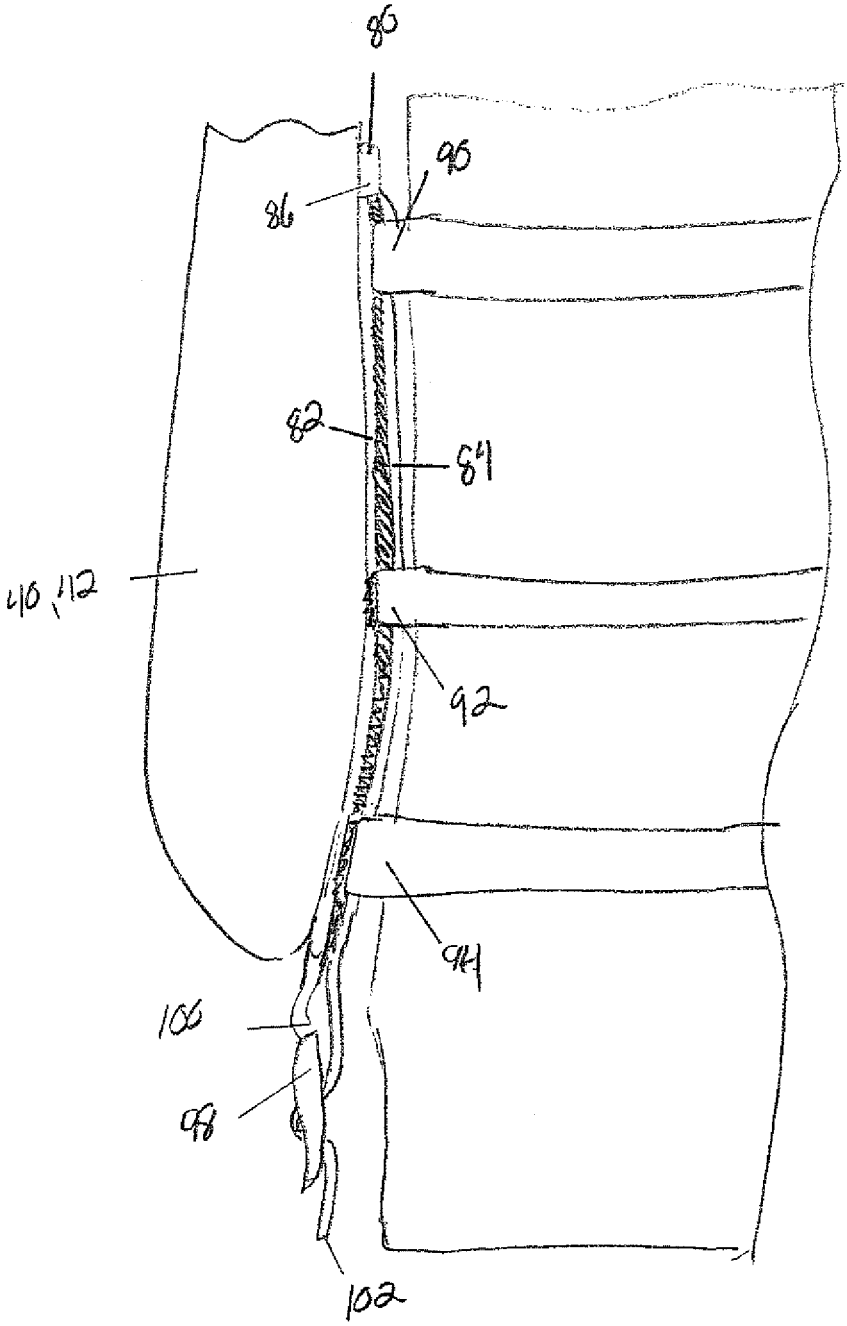
FIG. 15 depicts a sectional view of hook and loop strap system of FIG. 13 including a quick release connector.

Referring to FIG. 15, the hook and loop strap 80 can further include a quick release connector 98. The quick release connector 98 is connected to the bottom end 100 of the first section 82 of the hook and loop strap 80. The bottom end 102 of the second section 84 is threaded through the quick release connector 98, securing the bottom ends 100, 102 together.

The lifejacket portion 12 can be separated from the ballistic armor 70 by separating the second section 84 of the hook and loop strap 80 from the first section 82. Initially, the bottom end 102 of the second section 84 is unthreaded from the quick release connector 98. The first and second sections 82, 84 are separated, and the second section 84 is unthreaded from the straps 90, 92, 94 on the ballistic armor 70.

To quickly remove the lifejacket portion 12 from the wearer, the longitudinally extending legs 40, 42 of the lifejacket portion 12 are separated from front surface 71 of the ballistic armor 70. The quick release connector 54 on the neck strap 48 of the lifejacket portion 12 is used to decouple the first and second strap sections 50, 52 of the neck strap 48. The first section 50 of the neck strap 48 is unthreaded through the looped end 26 of the body strap 20, separating the lifejacket portion 12 from the body harness portion 14. As the longitudinally extending legs 40, 42 are no longer connected together with the neck strap 48, the longitudinally extending legs 40, 42 can be separated to remove the lifejacket portion 12 from about the wearer's neck. As the body harness portion 14 is worn under the ballistic armor 70 there is no need to remove the ballistic armor 70 for the removal of the life jacket 12. This method can be used to quickly remove to the lifejacket portion 12 from the wearer in either the inflated or deflated condition.

Alternatively, the ballistic armor 70 can be removed by the wearer without removing the lifejacket portion 12. Initially, the longitudinally extending legs 40, 42 of the lifejacket portion 12 are separated from front surface 71 of the ballistic armor 70. As shown in FIG. 9, the ballistic armor 70 is secured about the wearer with a series of torso and shoulder straps. The ballistic armor 70 is then removed from beneath the lifejacket portion 12 by uncoupling the torso and shoulder straps and sliding the ballistic armor 70 from beneath the lifejacket portion 12.

In the above example, the lifejacket portion 12 is depicted as having only a single inflatable bladder 28. However, it is contemplated that the lifejacket portion 12 can include multiple inflatable bladders as is know in the art.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A personal flotation device comprising:
a body harness portion;
a lifejacket portion removably attachable to the body harness portion, wherein the lifejacket portion comprises:
a neck strap including a first strap section, a second strap section, and a quick release connector releasably connecting the first strap section to the second strap section,
wherein the neck strap is threadable through the second looped end of the body strap to connect the lifejacket portion to the harness portion;
a waist belt; and
a body strap including a first end affixed to the waist belt and a second looped end.

2. A personal flotation device as set forth in claim 1, wherein the lifejacket portion is removable connected to the body harness portion by removably threading the first strap section of the neck strap through the second looped end of the body strap on the body harness portion and detachably coupling the first strap section to the second strap section with the quick release.

3. A personal flotation device as set forth in claim 2, wherein the lifejacket portion is separated from the body harness portion by decoupling the first strap section of the neck strap from the quick release and unthreading the first strap section through the second looped end of the body strap on the body harness portion.

4. A personal flotation device as set forth in claim 1, wherein the lifejacket portion further comprises:
an inflatable bladder being inflatable from a deflated condition to an inflated condition;
an outer casing having a generally u-shape defining a collar portion and two longitudinally extending legs, wherein the outer casing encloses the inflatable bladder in the deflated condition; and
an inflation mechanism operably connected to the inflatable bladder,
wherein the neck strap is affixed to and extends between the two longitudinally extending legs.

5. A personal flotation device as set forth in claim 4, wherein the outer casing includes an opening though which the inflatable bladder is expandable through in the inflated condition.

6. A personal flotation device as set forth in claim 5, wherein the two longitudinally extending legs are removably connectable to the waist belt of the body harness portion.

7. A personal flotation device comprising:
a body harness portion including a waist belt and a body strap having a first end affixed to the waist belt and a second looped end; and
a lifejacket portion including an inflatable bladder being inflatable from a deflated condition to an inflated condition, an outer casing positionable about the inflatable bladder in a deflated condition and having a generally u-shape defining a collar portion and first and second longitudinally extending legs, a first neck strap section affixed to the first longitudinally extending leg, a second neck strap section affixed to the second longitudinally extending leg, and a quick release connector releasably connecting the first neck strap section to the second neck strap section,
wherein the lifejacket portion is releasably connected to the body harness by removably threading the first neck strap section through the second looped end of the body strap on the body harness portion and detachably coupling the first neck strap section to the second neck strap section with the quick release.

8. A personal flotation device as set forth in claim 7, further comprising an inflation mechanism operable connected to the inflatable bladder.

9. A personal flotation device as set forth in claim 8, wherein the outer casing includes an opening though which the inflatable bladder is expandable through in the inflated condition.

10. A personal flotation device as set forth in claim 9, wherein the lifejacket portion is separated from the body harness portion by decoupling the first strap section of the neck strap from the quick release and unthreading the first neck strap section through the second looped end of the body strap on the body harness portion.

11. A method of removing a lifejacket from a wearer comprising:
providing a body harness portion on the wearer, the body harness portion including a waist belt removably positioned about a waist of the wearer and a body strap having a first end affixed to the waist belt and a second looped end positioned on the chest of the wearer;
providing a life jacket positioned about the neck of the wearer and including a neck strap having a first strap section threaded through the second looped end of the body strap and removable coupled to a quick release connector on a second strap section of the neck strap, and
decoupling the first strap section of the neck strap from the quick release connector of the second strap section of the neck strap;
unthreading the first strap section from the second looped end of the body strap;
removing the lifejacket portion from about the neck of the wearer, wherein the body harness portion remains positioned on the wearer.

* * * * *